US006851832B2

(12) United States Patent
Tieszen

(10) Patent No.: US 6,851,832 B2
(45) Date of Patent: Feb. 8, 2005

(54) LED TUBE LIGHT HOUSINGS

(76) Inventor: Dwayne A. Tieszen, P.O. Box 428, Ponder, TX (US) 76259

( * ) Notice: Subject to any disclaimer, the term of this patent is extended or adjusted under 35 U.S.C. 154(b) by 198 days.

(21) Appl. No.: 10/151,025

(22) Filed: May 21, 2002

(65) Prior Publication Data

US 2003/0218879 A1 Nov. 27, 2003

(51) Int. Cl.[7] ..... F21V 21/00

(52) U.S. Cl. ..... 362/249; 362/219; 362/800; 362/235

(58) Field of Search ..... 362/249, 800, 362/235, 219, 240, 252

(56) References Cited

U.S. PATENT DOCUMENTS

| | | | | | |
|---|---|---|---|---|---|
| 3,999,287 | A | | 12/1976 | Lockard | 29/622 |
| 4,173,035 | A | | 10/1979 | Hoyt | 362/249 |
| 4,255,042 | A | | 3/1981 | Armitage, Jr. et al. | 355/3 R |
| 4,266,140 | A | | 5/1981 | Kaufman | 250/551 |
| 4,422,719 | A | | 12/1983 | Orcutt | 350/96.3 |
| 4,478,588 | A | | 10/1984 | Lockard | 445/22 |
| 4,521,839 | A | | 6/1985 | Cook | 362/238 |
| 4,607,317 | A | * | 8/1986 | Lin | 362/249 |
| 4,633,582 | A | | 1/1987 | Ching et al. | 29/827 |
| 4,761,720 | A | | 8/1988 | Solow | 362/252 |
| 4,767,172 | A | | 8/1988 | Nichols et al. | 350/96.18 |
| 4,943,900 | A | | 7/1990 | Gärtner | 362/227 |
| 5,027,258 | A | | 6/1991 | Schöniger et al. | 352/31 |
| 5,095,413 | A | | 3/1992 | Goldberg | 362/238 |
| 5,155,669 | A | | 10/1992 | Yamuro | 362/252 |
| 5,313,729 | A | | 5/1994 | Sakai et al. | 40/452 |
| 5,321,593 | A | | 6/1994 | Moates | 362/251 |
| 5,452,188 | A | | 9/1995 | Green et al. | 362/227 |
| 5,575,459 | A | | 11/1996 | Anderson | 362/240 |
| 5,671,306 | A | | 9/1997 | York et al. | 385/36 |
| 5,765,940 | A | | 6/1998 | Levy et al. | 362/240 |
| 5,769,533 | A | | 6/1998 | Yamuro et al. | 362/249 |
| 5,927,845 | A | * | 7/1999 | Gustafson et al. | 362/152 |
| 6,072,171 | A | | 6/2000 | Nakamura et al. | 250/216 |
| 6,158,882 | A | | 12/2000 | Bischoff, Jr. | 362/488 |
| 6,170,964 | B1 | | 1/2001 | Hsu | 362/251 |
| 6,206,534 | B1 | | 3/2001 | Jenkins et al. | 362/31 |
| 6,250,785 | B1 | | 6/2001 | Mallia et al. | 362/511 |
| 6,268,600 | B1 | | 7/2001 | Nakamura et al. | 250/216 |
| 6,270,236 | B1 | | 8/2001 | Brussog | 362/249 |
| 6,283,612 | B1 | | 9/2001 | Hunter | 362/240 |
| 6,299,334 | B1 | | 10/2001 | Schwanz et al. | 362/511 |
| 6,354,714 | B1 | * | 3/2002 | Rhodes | 362/153.1 |
| 6,357,903 | B1 | | 3/2002 | Furusawa et al. | 362/555 |
| 6,357,904 | B1 | | 3/2002 | Kawashima | 362/555 |
| 6,361,186 | B1 | | 3/2002 | Slayden | 362/249 |
| 6,592,238 | B2 | * | 7/2003 | Cleaver et al. | 362/249 |

FOREIGN PATENT DOCUMENTS

| | | |
|---|---|---|
| WO | WO 97/27450 | 7/1997 |
| WO | WO 99/50626 | 10/1999 |

* cited by examiner

*Primary Examiner*—Thomas M. Sember
(74) *Attorney, Agent, or Firm*—Richard C. Litman

(57) ABSTRACT

LED tube light housings configured to control and orient the lateral position of inserted LEDs on a wiring harness. An LED tube light housing includes a first end, a second end, an inner surface, and an outer surface. First and second sections are generally formed inside the housing. The first section is configured in the form of a cavity for providing a vertical orientation of one or more LEDs. At least the top of the first section, e.g., the cavity, is transparent, translucent, or the like, to permit light emitted from LEDs contained therein to pass therethrough. The remaining portion of the housing may be transparent, translucent, opaque, or a combination thereof. The second section is configured to contain therein electrical components of the wiring harness. No printed circuit board portions are included in the wiring harness.

18 Claims, 9 Drawing Sheets

LED TUBE LIGHT HOUSINGS

BACKGROUND OF THE INVENTION

1. Field of the Invention

The present invention relates generally to lighting assemblies that employ light emitting diodes (LEDs), and more particularly to LED tube light housings.

2. Description of the Related Art

LEDs have been widely used to mark particular areas, illuminate dark areas, illuminate equipment, enhance the appearances of vehicles, etc. An LED is a semiconductor diode made of gallium arsenide, gallium phosphide, gallium nitride, silicon carbide, or the like, according to the color, the luminance and the intensity. LEDs convert electric energy efficiently into spontaneous and non-coherent electromagnetic radiation at visible and near-infrared wavelengths by electro-luminescence at a forward-biased pn junction. Upon being biased at the avalanche breakdown region, the pn junction forces an LED to emit visible light rays.

LEDs are very rugged and durable, exhibiting extremely long life because they emit light without heat, with no consumable filaments or gasses, having no voids, and perform with little regard for environmental conditions. In addition, LEDs are physically small, do not require high voltages to operate and consume minimal power compared with other active light sources. However, LEDs have several drawback characteristics that must be considered in their use. LED light output is highly directional, e.g., their viewing angle is narrow. Typical viewing angles are on the order of an included angle of only 20 degrees up to rare angles of 45 degrees. Viewed 'head-on', within their viewing angle, LEDs can appear very bright. But viewed outside of their viewing angle, LEDs quickly dim and disappear. Although not a problem with cosmetic or indicator applications, this characteristic severely limits LED use in practical or functional lighting. Until recently, LEDs were not a bright light source. This has changed, bringing LEDs into the arena of functional lighting applications, but the viewing angle restrictions of LEDs have remained.

The related art is represented by the following references of interest.

U.S. Pat. No. 3,999,287, issued on Dec. 28, 1976 to Joseph L. Lockard, describes a manually actuated switch. Lockard '287 does not suggest LED tube light housings according to the claimed invention.

U.S. Pat. No. 4,173,035, issued on Oct. 30, 1979 to Steven D. Hoyt, describes a flexible lighting strip. Hoyt does not suggest LED tube light housings according to the claimed invention.

U.S. Pat. No. 4,255,042, issued on Mar. 10, 1981 to John D. Armitage, Jr. et al., describes an erase apparatus for use in an electrophotographic copier machine. Armitage, Jr. does not suggest LED tube light housings according to the claimed invention.

U.S. Pat. No. 4,266,140, issued on May 5, 1981 to Lance R. Kaufman, describes positioning means for optically couplable circuit elements. Kaufman does not suggest LED tube light housings according to the claimed invention.

U.S. Pat. No. 4,422,719, issued on Dec. 27, 1983 to Donald E. Orcutt, describes a flexible transmitting guide. Orcutt does not suggest LED tube light housings according to the claimed invention.

U.S. Pat. No. 4,478,588, issued on Oct. 23, 1984 to Joseph L. Lockard, describes a light emitting diode assembly. Lockard '588 does not suggest LED tube light housings according to the claimed invention.

U.S. Pat. No. 4,521,839, issued on Jun. 4, 1985 to Brian A. Cook, describes a strip lighting system. Cook does not suggest LED tube light housings according to the claimed invention.

U.S. Pat. No. 4,633,582, issued on Jan. 6, 1987 to Steve Ching et al., describes an optoisolator leadframe. Ching et al. does not suggest LED tube light housings according to the claimed invention.

U.S. Pat. No. 4,761,720, issued on Aug. 2, 1988 to Joseph E. Solow, describes an illuminated tape. Solow does not suggest LED tube light housings according to the claimed invention.

U.S. Pat. No. 4,767,172, issued on Aug. 30, 1988 to Virginia R. Nichols et al., describes a light collector for an LED array. Nichols et al. does not suggest LED tube light housings according to the claimed invention.

U.S. Pat. No. 4,943,900, issued on Jul. 24, 1990 to Klauss Gartner, describes a lighting fixture. Gartner does not suggest LED tube light housings according to the claimed invention.

U.S. Pat. No. 5,027,258, issued on Jun. 25, 1991 to Karl-Heinz Schöniger et al., describes a manually actuated switch. Schöniger et al. does not suggest LED tube light housings according to the claimed invention.

U.S. Pat. No. 5,095,413, issued on Mar. 10, 1992 to Gerald M. Goldberg, describes an electric lamp assembly. Goldberg does not suggest LED tube light housings according to the claimed invention.

U.S. Pat. No. 5,155,669, issued on Oct. 13, 1992 to Yukio Yamuro, describes a light emitting apparatus. Yamuto does not suggest LED tube light housings according to the claimed invention.

U.S. Pat. No. 5,313,729, issued on May 24, 1994 to Hiroo Sakai et al., describes a manually actuated switch. Sakai et al. does not suggest LED tube light housings according to the claimed invention.

U.S. Pat. No. 5,321,593, issued on Jun. 14, 1994 to Martin G. Moates, describes a strip lighting system using light emitting diodes. Moates does not suggest LED tube light housings according to the claimed invention.

U.S. Pat. No. 5,452,188, issued on Sep. 19, 1995 to Timothy M. Green et al., describes a modular strobe bar. Green does not suggest LED tube light housings according to the claimed invention.

U.S. Pat. No. 5,575,459, issued on Nov. 19, 1996 to Robert A. Anderson, describes a light emitting diode array. Anderson does not suggest LED tube light housings according to the claimed invention.

U.S. Pat. No. 5,671,306, issued on Sep. 23, 1997 to Allan B. York et al., describes a lighting structure for intensely illuminating a narrow linear region. York et al. does not suggest LED tube light housings according to the claimed invention.

U.S. Pat. No. 5,765,940, issued on Jun. 16, 1998 to Robert Levy et al., describes a manually actuated switch. Levy et al. does not suggest LED tube light housings according to the claimed invention.

U.S. Pat. No. 5,769,533, issued on Jun. 23, 1998 to Yukio Yamuro et al., describes a flexible illumination tape. Yamuro et al. does not suggest LED tube light housings according to the claimed invention.

U.S. Pat. No. 5,927,845, issued on Jul. 27, 1999 to Thomas L. Gustafson et al., describes an integrally formed linear light strip with light emitting diodes. Gustafson does not suggest LED tube light housings according to the claimed invention.

U.S. Pat. No. 6,072,171, issued on Jun. 6, 2000 to Tetsuroh Nakamura et al., describes a linear illumination device. Nakamura et al. '171 does not suggest LED tube light housings according to the claimed invention.

U.S. Pat. No. 6,158,882, issued on Dec. 12, 2000 to A. John Bischoff, Jr., describes an LED semiconductor lighting system. Bischoff, Jr. does not suggest LED tube light housings according to the claimed invention.

U.S. Pat. No. 6,170,964 B1, issued on Jan. 9, 2001 to Owen Hsu, describes an ornamental lighting device with a flexibly-shapable light emitting tube capable of portraying user-designed signs in a flickering manner. Hsu does not suggest LED tube light housings according to the claimed invention.

U.S. Pat. No. 6,206,534 B1, issued on Mar. 27, 2001 to David Jenkins et al., describes an illumination device for use in image reading applications. Jenkins et al. does not suggest LED tube light housings according to the claimed invention.

U.S. Pat. No. 6,250,785 B1, issued on Jun. 26, 2001 to Lino Mallia et al., describes a vehicle light assembly. Mallia et al. does not suggest LED tube light housings according to the claimed invention.

U.S. Pat. No. 6,268,600 B1, issued on Jul. 31, 2001 to Tetsuroh Nakamura et al., describes a linear illumination device. Nakamura et al. '600 does not suggest LED tube light housings according to the claimed invention.

U.S. Pat. No. 6,270,236 B1, issued on Aug. 7, 2001 to Ingo Brussog, describes an LED lighting unit with a transparent carrier panel. Brussog does not suggest LED tube light housings according to the claimed invention.

U.S. Pat. No. 6,283,612 B1, issued on Sep. 4, 2001 to Mark A. Hunter, describes a light emitting diode strip. Hunter does not suggest LED tube light housings according to the claimed invention.

U.S. Pat. No. 6,299,334 B1, issued on Oct. 9, 2001 to Martina Schwanz et al., describes a vehicle lamp. Schwanz et al. does not suggest LED tube light housings according to the claimed invention.

U.S. Pat. No. 6,357,903 B1, issued on Mar. 19, 2002 to Satoshi Furusawa et al., describes a manually actuated switch. Furusawa et al. does not suggest LED tube light housings according to the claimed invention.

U.S. Pat. No. 6,357,904 B1, issued on Mar. 19, 2002 to Shingo Kawashima, describes a linear illumination device. Kawashima does not suggest LED tube light housings according to the claimed invention.

U.S. Pat. No. 6,361,186 B1, issued on Mar. 26, 2002 to James C. Slayden, describes a simulated neon light using LED's. Kawashima does not suggest LED tube light housings according to the claimed invention.

International Patent document WO 97/27450, published on Jul. 31, 1997, describes a position tracking system. International '450 does not suggest LED tube light housings according to the claimed invention.

International Patent document WO 99/50626, published on Oct. 7, 1999, describes enhancements in radiant energy transducer systems. International '626 does not suggest LED tube light housings according to the claimed invention.

None of the above inventions and patents, taken either singularly or in combination, is seen to describe the instant invention as claimed.

SUMMARY OF THE INVENTION

The present invention are LED tube light housings configured to control and orient the lateral position of inserted LEDs on a wiring harness. An LED tube light housing according to the invention includes a first end, a second end, an inner surface, and an outer surface. The housing may be manufactured from rigid or flexible material. First and second sections are generally formed inside the housing.

The first section is configured in the form of a cavity for providing a vertical orientation of one or more LEDs. At least the top of the first section, e.g., the cavity, is transparent, translucent, or the like, to permit light emitted from LEDs contained therein to pass therethrough. The remaining portion of the housing may be transparent, translucent, opaque, or a combination thereof. The second section is configured to contain therein electrical components of the wiring harness. The wiring harness may include LEDs, fuses, resistors, wiring, and wiring splices. No printed circuit board portions are included in the wiring harness. The housing may also include a socket covering for one end, and may include a plug covering for the other end to enable multiple housings to be interconnected. The housing may also include a molded end cap.

One example of an LED tube housing is generally configured so a cross-section of the first section is generally U-shaped and is inverted, and cooperates with the second section that has a cross-section that is generally rectangularly shaped. The first section is configured to slidingly receive one or more LEDs.

Another example of an LED tube housing is generally rectangularly shaped. This housing is configured so a cross-section of the first section is generally rectangularly shaped, and cooperates with the second section that has a cross-section that is generally rectangularly shaped. The first section is configured in the form of two vertical walls that are spaced from each other by a distance that permits slidingly receiving one or more LEDs.

Another example of an LED tube housing is generally rectangularly shaped. This housing is configured so a cross-section of the first section is generally rectangularly shaped, and cooperates with the second section that has a cross-section that is generally rectangularly shaped. The first section is configured in the form of two vertical walls that are spaced from each other by a distance that permits slidingly receiving one or more LEDs. This housing also includes laterally extending portions from the top of the first section. These laterally extending portions may be configured in the form of hooks to permit the housing to be snapped onto a supporting member.

Accordingly, it is a principal aspect of the invention to provide LED tube light housings configured for controlling and orienting lateral positions of LEDs on a wiring harness contained therein.

It is another aspect of the invention to provide LED tube light housings that are not configured for LEDs mounted on printed circuit board portions.

It is an aspect of the invention to provide improved elements and arrangements thereof in LED tube light housings for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1A, 1B:
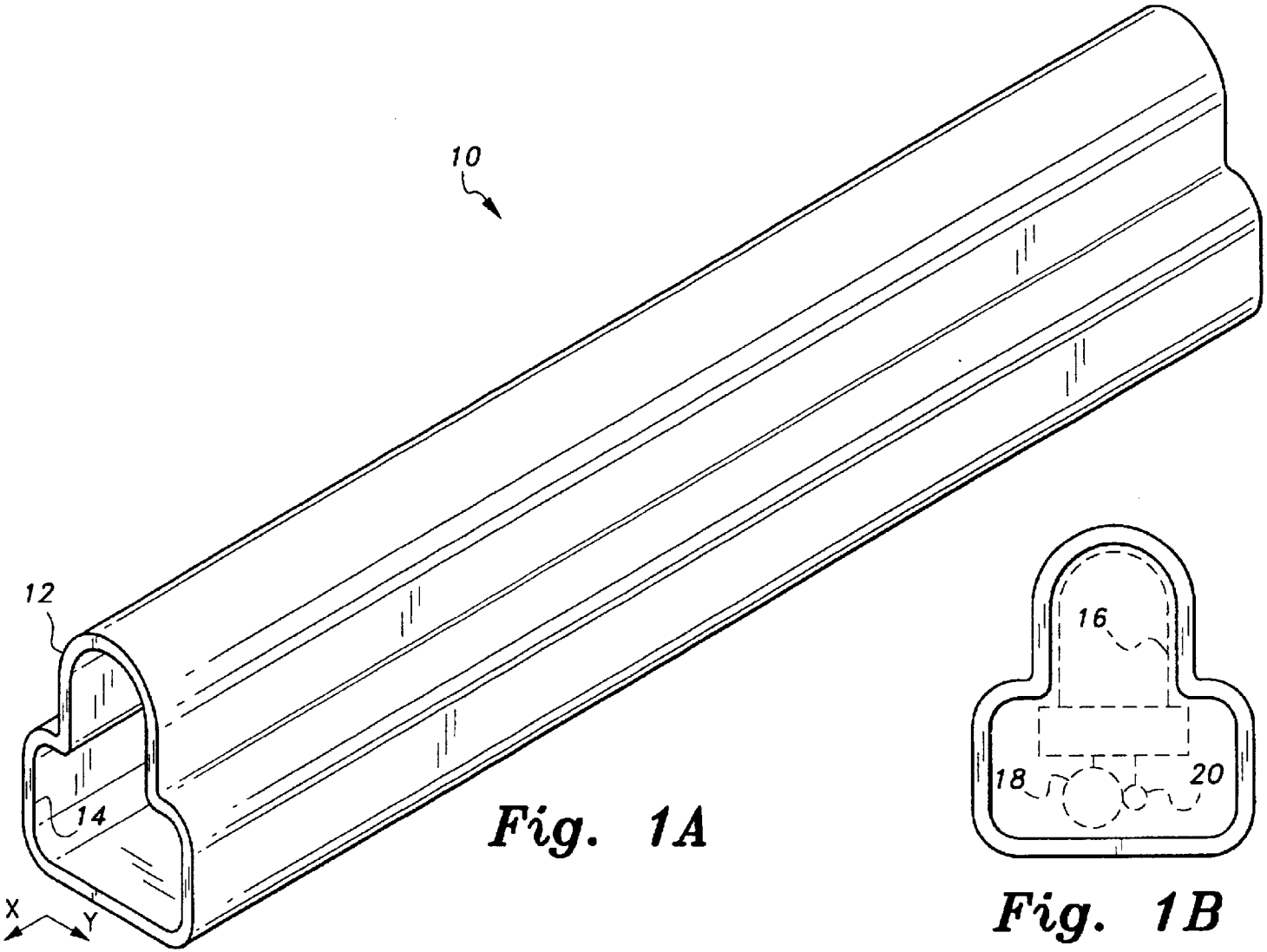
FIG. 1A is a perspective, side view of an LED tube light housing according to the present invention.
FIG. 1B is a front view of the LED tube light housing shown in FIG. 1A.

The present invention are LED tube light housings. The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

As shown in the drawings, particularly FIGS. 1A–3B, the present invention are LED tube light housings 10,30,50 that provide control of axes and directions of light output of multiple LEDs configured on a wire harness. An LED tube light housing according to the invention includes a first end, a second end, an inner surface, and an outer surface. The housing may be manufactured from rigid or flexible material. For example, the material may be polycarbonate plastic or the like.

First and second sections are generally formed inside the housing. The first section is configured in the form of a channel for providing a vertical orientation of one or more LEDs. At least the top of the first section, e.g., the channel, is transparent, translucent, or the like, to permit light emitted from LEDs contained therein to pass therethrough. The remaining portion of the housing may be transparent, translucent, opaque, or a combination thereof. The second section is configured to contain therein electrical components of the wiring harness. The wiring harness includes wiring, and wiring splices, and may include resistors, fuses, etc. No printed circuit board portions are included in the wiring harness. The housing may also include a socket covering for one end, and may include a plug covering for the other end to enable multiple housings to be interconnected. The housing may also include a molded end cap. The exact dimensions of the housings may vary depending upon desires of the target user. First and second sections are generally formed inside the housing.

FIGS. 1A and 1B illustrate one example of an LED tube light housing according to the invention. LED tube light housing 10 includes a first end, a second end, an outer surface 12, and an inner surface 14. First and second sections are generally formed inside housing 10. Housing 10 is manufactured from durable, flexible material such as polycarbonate plastic or the like. The first section is configured in the form of a cavity that controls and orients the lateral position of inserted LEDs on a wiring harness. At least the top of the first section, e.g., the cavity, is transparent, translucent, or the like, to permit light emitted from LEDs contained therein to pass therethrough. The remaining portion of the housing may be transparent, translucent, opaque, or a combination thereof.

Figure 5A:
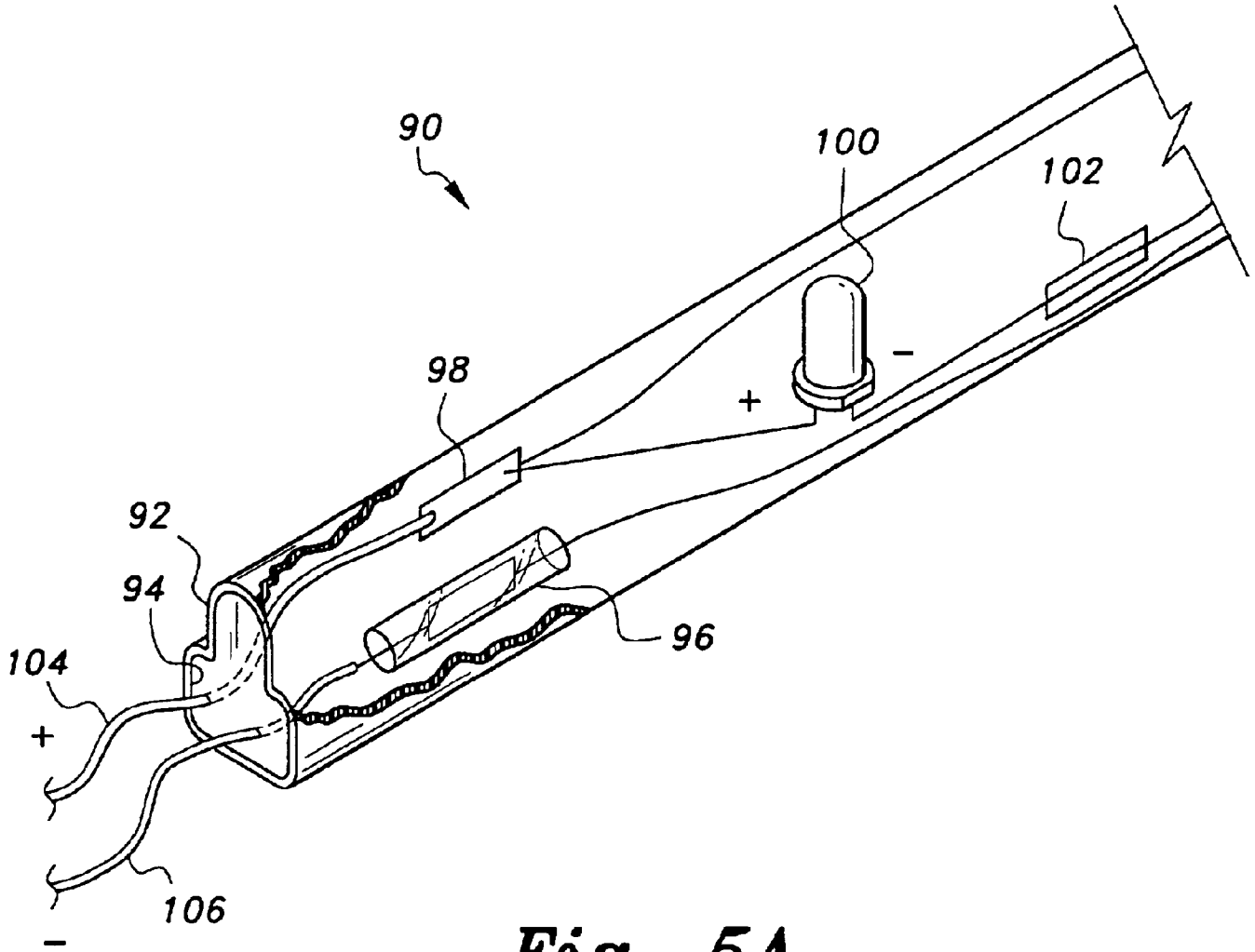
FIG. 5A is a perspective, breakaway view of a first end of an LED tube light housing according to the present invention.
Figure 5B:
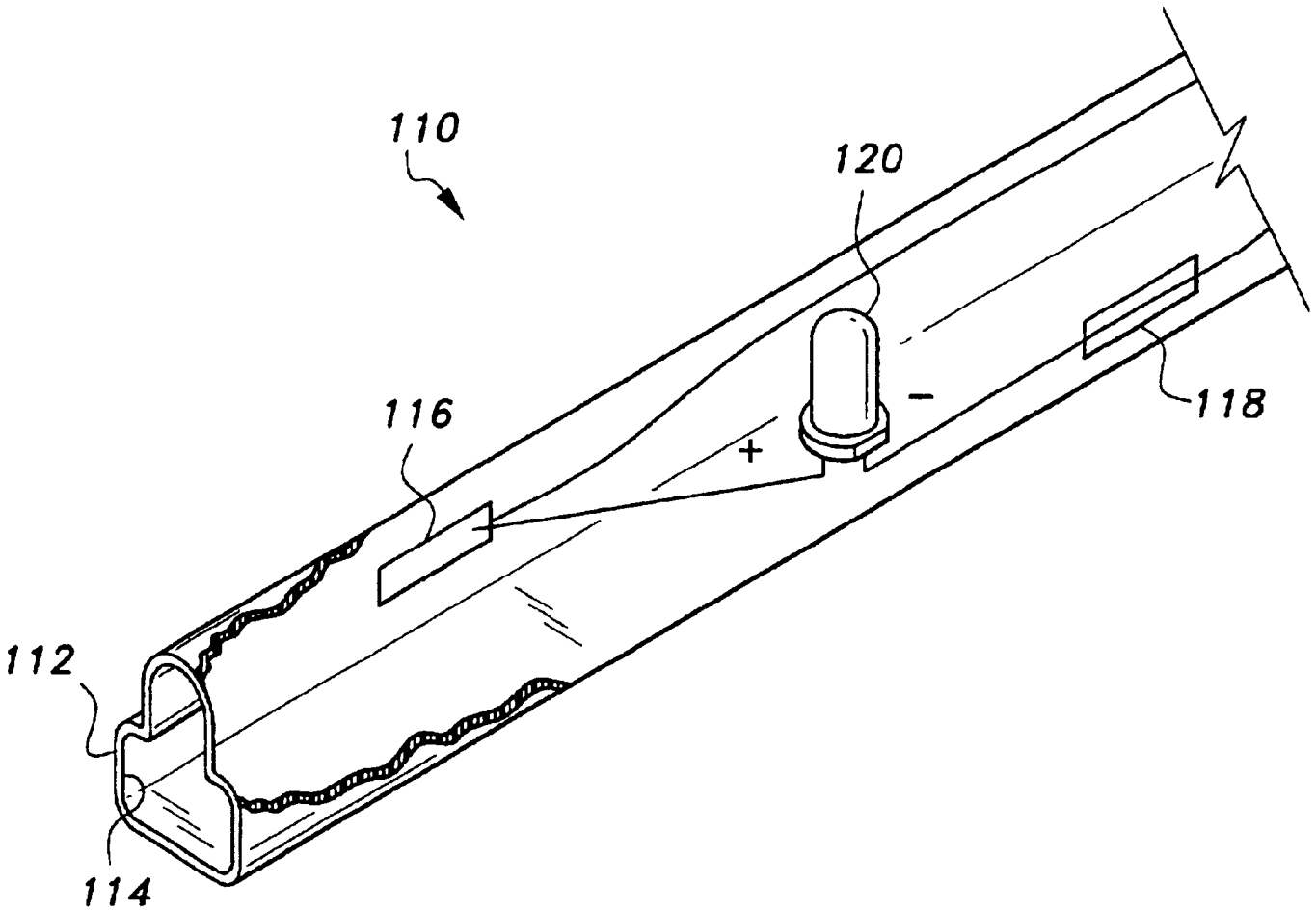
FIG. 5B is a perspective, breakaway view of a second end of an LED tube light housing according to the present invention.
Figure 5C:
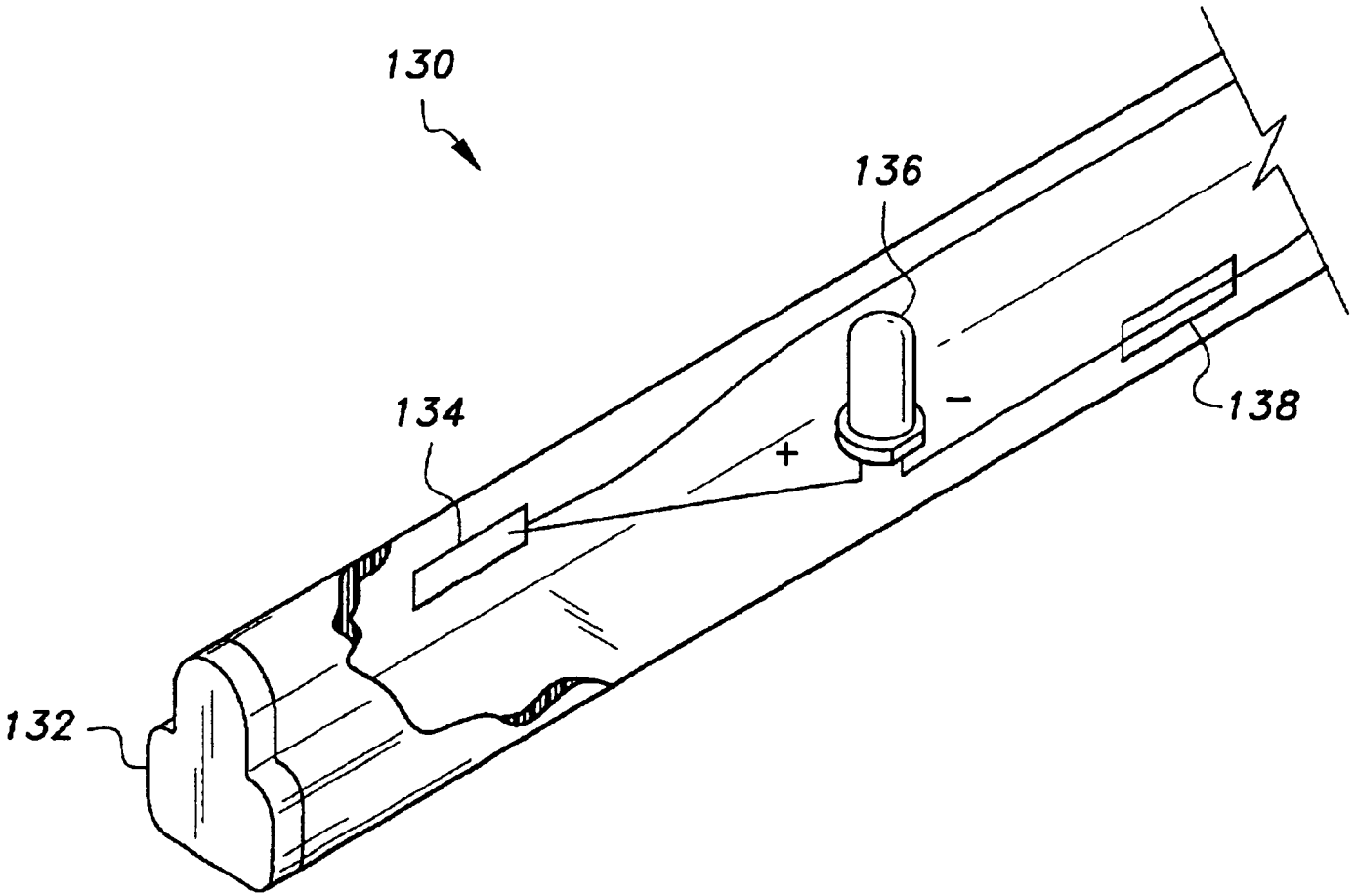
FIG. 5C is a perspective, breakaway view of a third end of an LED tube light housing according to the present invention.
Figure 6A:
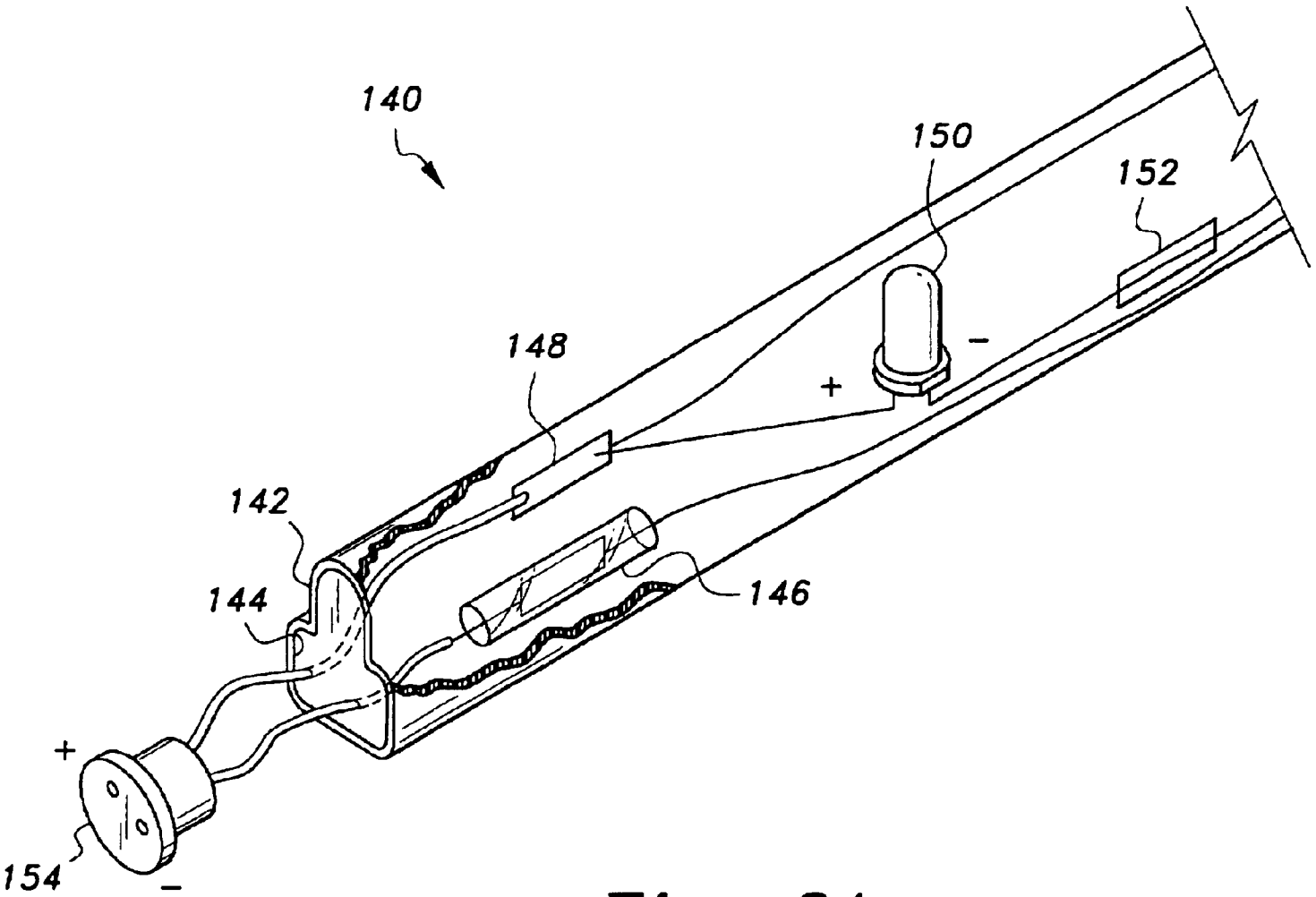
FIG. 6A is a perspective, breakaway view of a fourth end of an LED tube light housing according to the present invention.
Figure 6B:
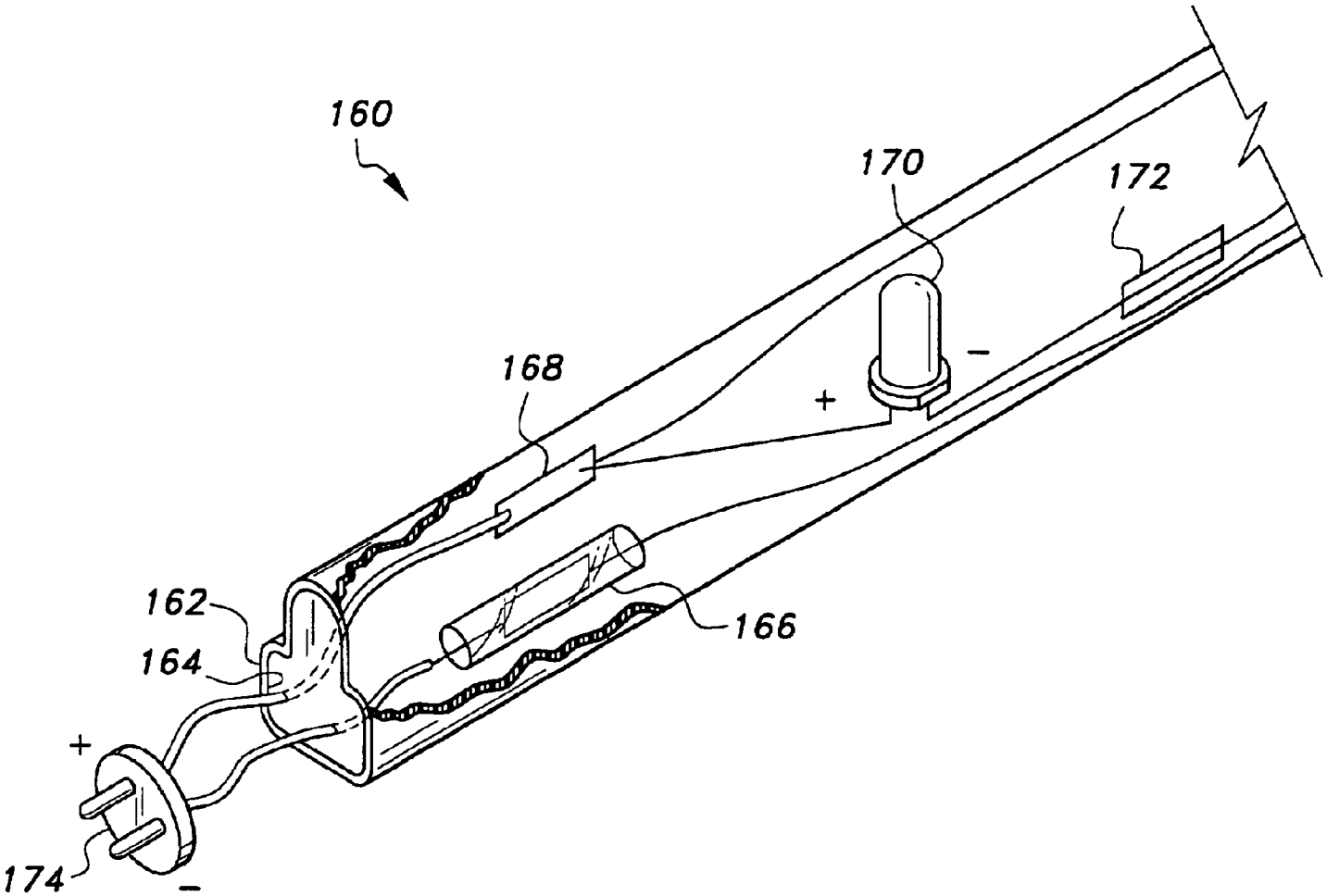
FIG. 6B is a perspective, breakaway view of a fifth end of an LED tube light housing according to the present invention.

LED tube light housing 10 is generally configured so a cross-section of the first section is generally U-shaped and is inverted, and cooperates with the second section that has a cross-section that is generally rectangularly shaped. The first section is configured to slidingly receive one or more LEDs. The second section is configured to contain therein electrical components of the wiring harness. The wiring harness includes LEDs 16, fuses 18, resistors 20, wiring, wiring splices, etc. No printed circuit board portions are included in the wiring harness. The housing may also include a socket covering for one end, and may include a plug covering for the other end to enable multiple housings to be interconnected (see socket covering 154 in FIG. 6A and plug covering 174 in FIG. 6B). Housing 10 may also include a molded end cap (see molded end cap 132 in FIG. 5C). The exact dimensions of housing 10 may vary depending upon desires of the target user.

Figures 2A, 2B:
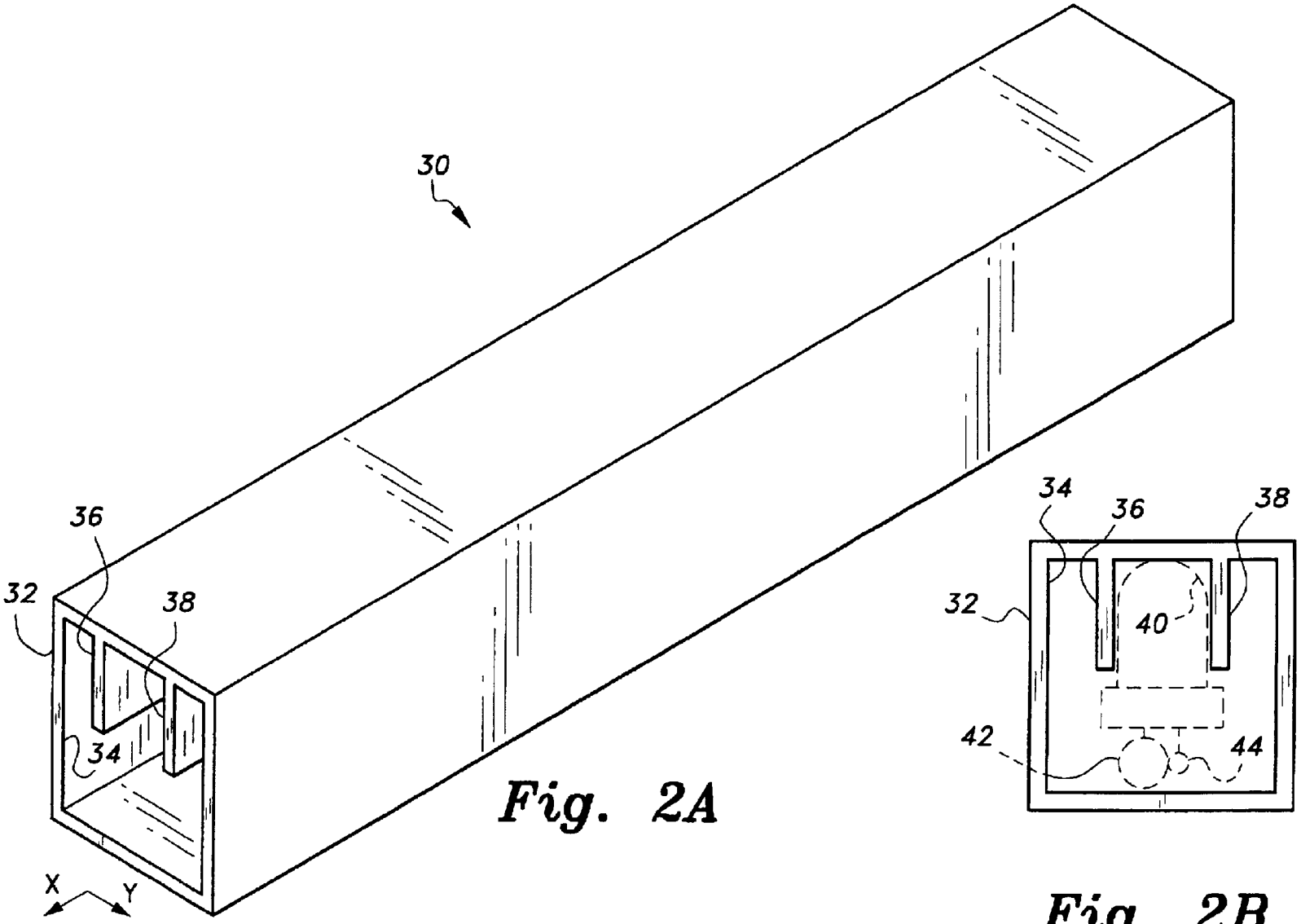
FIG. 2A is a perspective, side view of an LED tube light housing according to the present invention.
FIG. 2B is a front view of the LED tube light housing shown in FIG. 2A.

FIGS. 2A and 2B illustrate another example of an LED tube light housing according to the invention. LED tube light housing 30 includes a first end, a second end, an outer surface 32, and an inner surface 34. First and second sections are generally formed inside housing 30. Housing 30 is manufactured from durable, flexible material such as polycarbonate plastic or the like.

The first section is configured in the form of a cavity that controls and orients the lateral position of inserted LEDs on a wiring harness. A cross-section of the first section is generally rectangularly shaped, and cooperates with the second section that has a cross-section that is generally rectangularly shaped. The first section is configured in the form of two vertical walls 36 and 38 that are spaced from each other by a distance that permits slidingly receiving one or more LEDs 40. At least the top of the first section, e.g., the cavity, is transparent, translucent, or the like, to permit light emitted from LEDs contained therein to pass therethrough. The remaining portion of the housing may be transparent, translucent, opaque, or a combination thereof.

The second section is configured to contain therein electrical components of the wiring harness. The wiring harness may include LEDs 40, fuses 42, resistors 44, wiring, etc. No printed circuit board portions are included in the wiring harness. The housing may also include a socket covering for one end, and may include a plug covering for the other end to enable multiple housings to be interconnected (see socket covering 154 in FIG. 6A and plug covering 174 in FIG. 6B). Housing 30 may also include a molded end cap (see molded end cap 132 in FIG. 5C). The exact dimensions of housing 30 may vary depending upon desires of the target user.

Figures 3A, 3B:
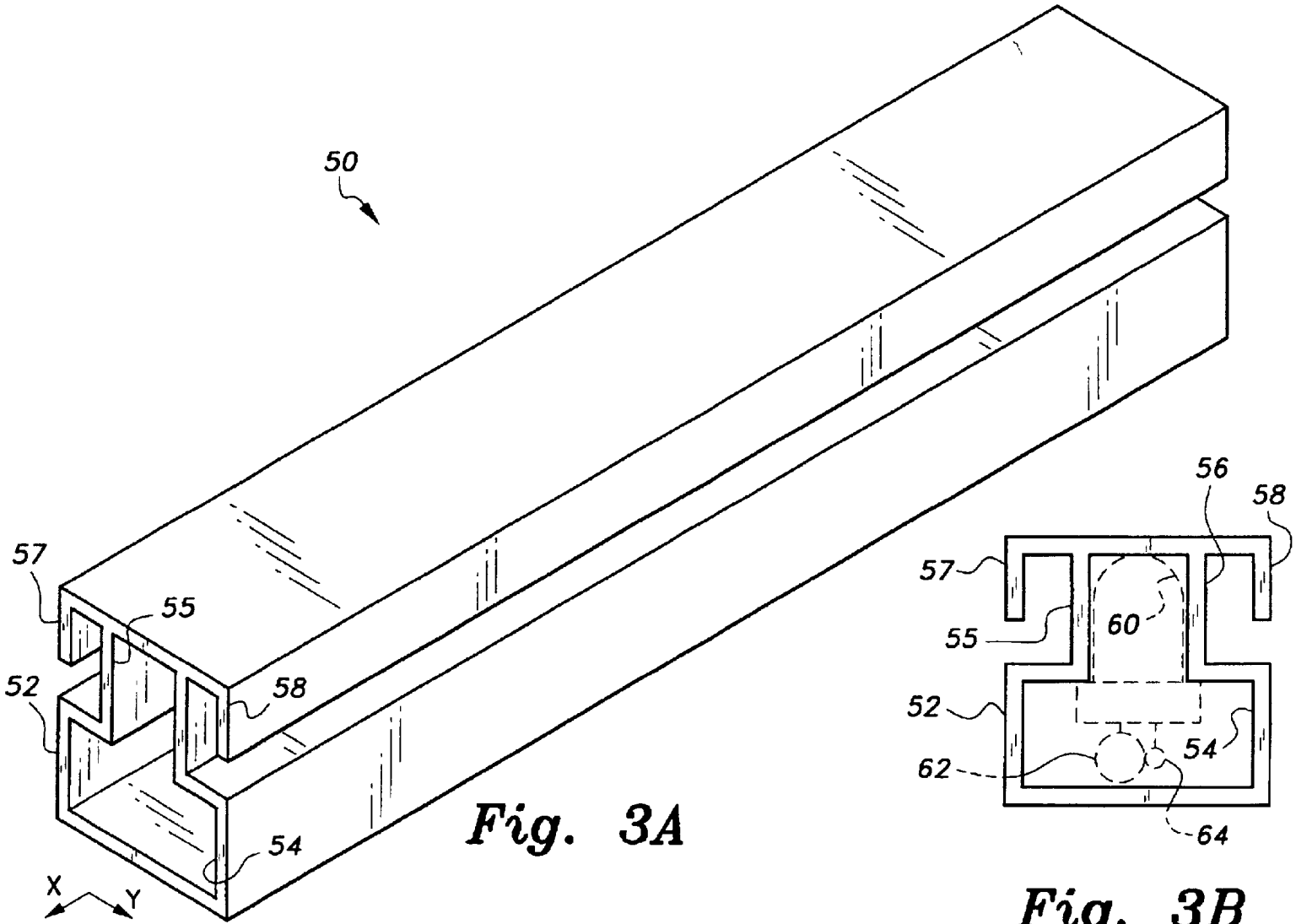
FIG. 3A is a perspective, side view of an LED tube light housing according to the present invention.
FIG. 3B is a front view of the LED tube light housing shown in FIG. 3A.
Figure 4:
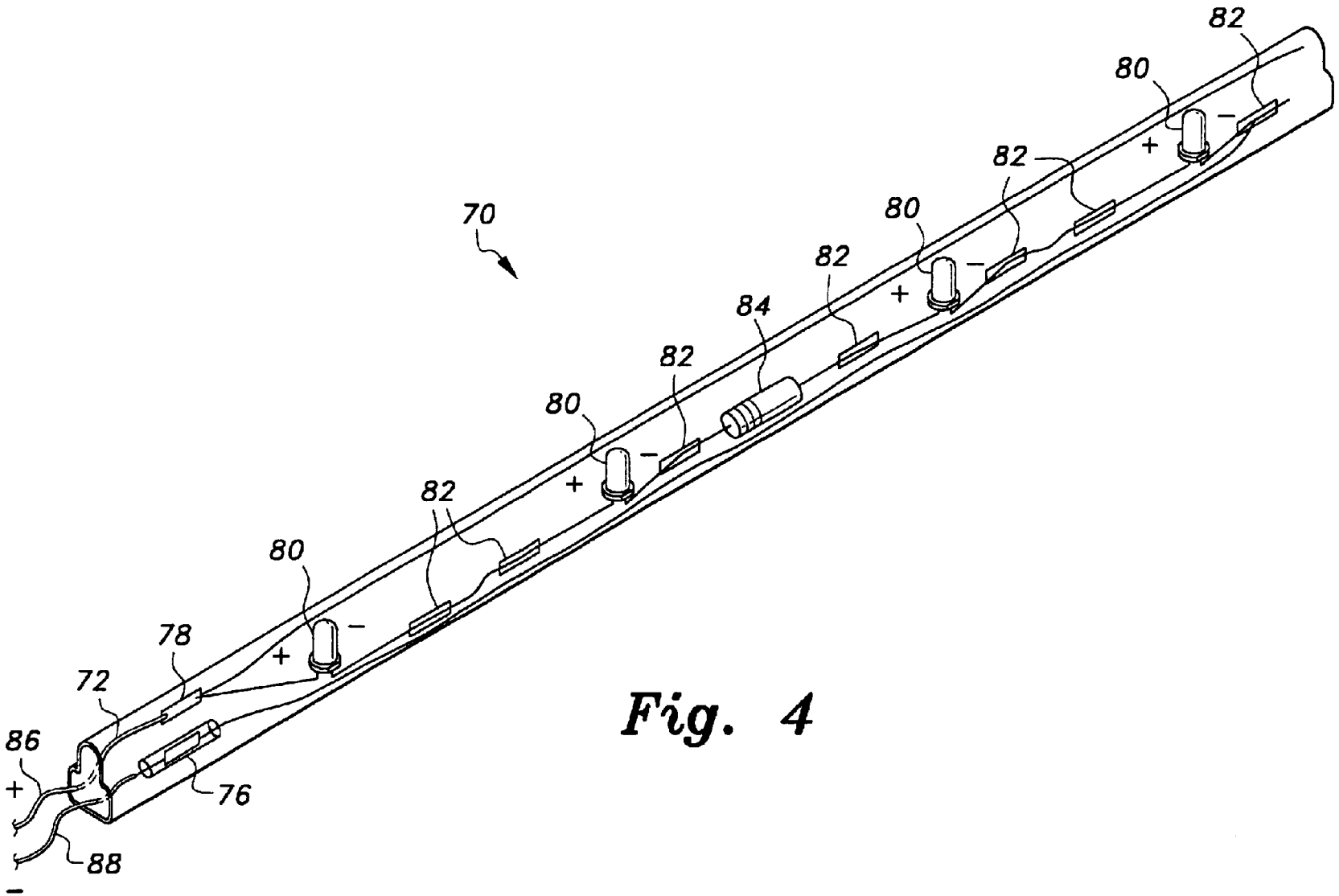
FIG. 4 is a perspective, breakaway view of an LED tube light housing according to the present invention.

FIGS. 3A and 3B illustrate another example of an LED tube light housing according to the invention. LED tube light housing 50 includes a first end, a second end, an outer surface 52, and an inner surface 54. First and second sections are generally formed inside housing 50. Housing 50 is manufactured from durable, flexible material such as polycarbonate plastic or the like.

The first section is configured in the form of a cavity that controls and orients the lateral position of inserted LEDs on a wiring harness. A cross-section of the first section is generally rectangularly shaped, and cooperates with the second section that has a cross-section that is generally rectangularly shaped. The first section is configured in the form of two vertical walls 36 and 38 that are spaced from each other by a distance that permits slidingly receiving one or more LEDs 40. At least the top of the first section, e.g., the cavity, is transparent, translucent to permit light emitted from LEDs contained therein to pass therethrough. Portions 57 and 58 laterally extend from the top of the first section. These laterally extending portions 57 and 58 may be configured in the form of hooks to permit the housing to be snapped onto a supporting member. The remaining portion of housing 50 may be transparent, translucent, opaque, or a combination thereof.

The second section is configured to contain therein electrical components of the wiring harness. The wiring harness may include LEDs 60, fuses 62, resistors 64, wiring, etc. No printed circuit board portions are included in the wiring harness. Housing 50 may also include a socket covering for one end, and may include a plug covering for the other end to enable multiple housings to be interconnected (see socket covering 154 in FIG. 6A and plug covering 174 in FIG. 6B). Housing 50 may also include a molded end cap (see molded end cap 132 in FIG. 5C). The exact dimensions of housing 50 may vary depending upon desires of the target user.

While the invention has been described with references to its preferred embodiment, it will be understood by those skilled in the art that various changes may be made and equivalents may be substituted for elements thereof without departing from the true spirit and scope of the invention.

I claim:

1. A light emitting diode (LED) tube light housing in combination with a wiring harness, said wiring harness comprising:

at least one LED;

electrical components; and no printed circuit board portions; and said LED tube light housing comprising:

a first end;

a second end;

an inner surface;

an outer surface, a first section configured to slidingly receive, control, and orient a lateral position of said at least one LED; and a second section configured to contain therein said electrical components of said wiring harness.

2. The combination according to claim 1, wherein said housing is plastic.

3. The combination according to claim 2, wherein said housing is transparent.

4. The combination according to claim 2, wherein said housing is translucent.

5. The combination according to claim 2, wherein said housing is a combination of transparent and opaque.

6. The combination according to claim 2, wherein said housing is a combination of translucent and opaque.

7. The combination according to claim 2, wherein said housing is a combination of transparent, translucent, and opaque.

8. The combination according to claim 1, wherein said electrical components include at least one fuse, at least one resistor, wiring, and wiring splices.

9. The combination according to claim 8, further comprising a socket covering for one of the first and second ends.

10. The combination according to claim 8, further comprising a plug covering for one of the first and second ends.

11. The combination according to claim 8, further comprising a molded end cap.

12. The combination according to claim 1, wherein a cross-section of the first section is generally U-shaped and is inverted, and cooperates with the second section that has a cross-section that is generally rectangularly shaped.

13. The combination according to claim 12, wherein the first section is configured to slidingly receive at least one LED.

14. The combination according to claim 1, wherein the first section is configured in the form of two vertical walls that are spaced from each other by a distance that permits slidingly receiving at least one LED.

15. The combination according to claim 1, wherein a cross-section of the first section is generally rectangularly shaped, and cooperates with the second section that has a cross-section that is generally rectangularly shaped.

16. The combination according to claim 15, wherein the first section is configured in the form of two vertical walls that are spaced from each other by a distance that permits slidingly receiving at least one LED.

17. The combination according to claim 16, further comprising portions laterally extending from a top of the first section.

18. The combination according to claim 17, wherein the portions laterally extending from the top of the first section are configured to permit the housing to be snapped onto a supporting member.

* * * * *